US005547204A

United States Patent [19]

Gamzo

[11] Patent Number: 5,547,204

[45] Date of Patent: Aug. 20, 1996

[54] MULTIPURPOSE MOBILE DEVICE WITH OPEN SIDED FOOT ENGAGEMENT

[76] Inventor: Israel Gamzo, 709 Solano Ave., Albany, Calif. 94706

[21] Appl. No.: 225,801

[22] Filed: Apr. 11, 1994

[51] Int. Cl.[6] ..... A63C 17/00; A63C 17/14; A63C 17/18; A63C 17/28

[52] U.S. Cl. ..... 280/11.19; 280/11.2; 280/11.3; 280/11.36; 280/7.14; 280/600; 280/611; 280/87.021; 280/87.041; 280/14.2; 280/22.1; D21/226; D21/228

[58] Field of Search ..... 280/11.12, 11.19, 280/11.2, 11.3, 11.31, 11.36, 7.13, 7.14, 14.1, 14.2, 22.1, 600, 611, 811, 841, 842, 87.041, 87.042, 87.021; D21/226, 227, 228; 441/70, 76

[56] References Cited

U.S. PATENT DOCUMENTS

| | | | |
|---|---|---|---|
| D. 183,837 | 11/1958 | Hammond | D21/229 |
| D. 232,108 | 7/1974 | Krause | 280/11.19 X |
| 938,168 | 10/1909 | Nolan | 280/7.13 |
| 1,075,250 | 10/1913 | Gingold | 280/7.14 |
| 1,566,706 | 12/1925 | Thomas | 280/841 |
| 1,775,895 | 9/1930 | Dupuis | 280/11.19 |
| 1,934,535 | 11/1933 | Hast | 280/11.31 X |
| 2,253,012 | 8/1941 | Benner et al. | 280/11.19 |
| 2,841,805 | 7/1958 | Roudebush | 9/21 |
| 3,056,148 | 10/1962 | Abbott et al. | D21/230 |
| 3,153,543 | 10/1964 | Magyar | 280/7.13 |
| 3,571,832 | 3/1971 | Rauch | 9/310 |
| 3,856,321 | 12/1974 | Solymosi | 280/87.04 |
| 3,891,225 | 6/1975 | Sessa | 280/11.19 |
| 3,907,319 | 9/1975 | Berlied, Jr. | 280/11.35 |
| 4,046,400 | 9/1977 | Viletto | 280/626 |
| 4,175,759 | 11/1979 | Strunk | 280/14.2 |
| 4,235,448 | 11/1980 | Thomas | 280/87.042 X |
| 4,438,919 | 3/1984 | Gamzo | 272/1 B |
| 4,865,342 | 9/1989 | Kong | 280/87.042 |
| 5,009,441 | 4/1991 | Toft | 280/14.2 |

FOREIGN PATENT DOCUMENTS

| | | | |
|---|---|---|---|
| 3319874 | 12/1984 | Germany | 280/11.3 |

OTHER PUBLICATIONS

Advertisement entitled "For the Record—Cross Terrain Wheelz", Transworld Skateboarding Magazine, Oct. 1991

Catalog excerpt entitled Techni–Ski, source and date not known.

Popular Mechanics, Letter entitled "4–Season Wagon" Mar., 1992.

*Primary Examiner*—Brian L. Johnson

*Attorney, Agent, or Firm*—Harris Zimmerman

[57] ABSTRACT

A device for traveling a standing, sitting or prone person along a surface has a foot engaging component which facilitates control of the device and retention of the device at the user's feet while also enabling quick unimpeded entry and withdrawal of the feet by lateral movement of the feet. The device may be configured for any of diverse activities such as skateboarding, skiing, snowboarding and surfboarding among others. The device may have interchangeable surface contacting components which enable quick restructuring of the device for use in different activities of these kinds. In one form, the foot engaging component has side-by-side boot shaped foot chambers which extend in the direction of travel and which are open at their outer sides. In another form, the foot engaging component has a single open sided foot chamber and pairs are used for activities, such as skiing or roller skating for example, where independent movement of devices attached to the person's feet is required.

31 Claims, 9 Drawing Sheets

MULTIPURPOSE MOBILE DEVICE WITH OPEN SIDED FOOT ENGAGEMENT

TECHNICAL FIELD

This invention relates to apparatus for enabling travel of a standing, sitting or prone person along a surface, examples of apparatus to which the invention relates being skateboards, sleds, scooters, snow or water skis and roller skates or roller blades. In one aspect, the invention relates to devices of this kind which have components for engaging the user's feet. In another aspect, the invention relates to devices of this kind which are convertible from one configuration to another to enable use of the device for different activities.

BACKGROUND OF THE INVENTION

A variety of different recreational devices employ wheels, skis, blades or elongated boards to enable movement of a standing or sitting person along an underlying surface. Such devices have different forms in part to enable different types of recreational activity and in part to accommodate to different underlying surfaces which may variously be land, pavement, snow, ice or a body of water.

Prior devices of this kind, such as skateboards, snow boards, surfboards, skis and the like are typically useful only for one specific type of activity. Efforts have heretofore been made to enable use of a given device for more than one activity or to enable use under different weather and/or surface conditions but prior devices of this kind have provided only a very limited degree of adaptability to different activities. Typically such prior devices enable only two alternate uses such as in wheeled devices which can optionally be provided with skids to adapt the device for Winter operation or as in skates which can be restructured for operation as either roller skates or ice skates.

Many persons participate in more than one recreational activity of this kind or their choice of activities may change over a period of time. Skateboarders, for example, may wish to switch to the highly similar activity of snowboarding during Winter or to surfboarding when they have access to a beach. Downhill or alpine skiers may also enjoy water skiing depending on the season and locale. Roller skaters may wish to switch to in-line skates of the type having aligned wheels such as are sold under the trademark ROLLERBLADE.

As a practical matter, persons who wish to participate in a variety of these activities have generally found it necessary to purchase separate items of equipment for each purpose. This can be very costly. Further problems can be encountered in connection with storing and transporting bulky collections of such recreational equipment.

The different types of mobile devices have different arrangements for engaging with the feet of the user. In some cases, such as in many skateboards for example, there are no components for that specific purpose. The users simply stand on the boards as it is necessary that they be able to move their feet on and off the boards for the purpose of propelling the along the ground. Such skateboarders must use their hands to hold the board at their feet while performing "air" maneuvers during which the board leaves the ground. In other activities, such as downhill skiing for example, it has been thought to be necessary that the skier's feet be positively and rigidly fastened to the skis by specialized ski boots and bindings for safety reasons and to assure control. Most skates having some form of positive fastening of the foot to the device which must be unbuckled or unlaced before the foot can be separated from the device. Water skis or boards typically have an intermediate degree of coupling of the skier's feet to the skis or board. The front of the feet are inserted into straps on the skis or board and can easily be withdrawn rearwardly if desired.

Prior arrangements for engaging the persons feet that are necessary and appropriate for one type of activity may be unworkable, unsafe or at best uncomfortable if they are used on devices designed for other activities. Production of a mobile device which is easily adaptable for use in any of a variety of activities of the above discussed kind requires a new form of foot engagement. The engagement should enable secure retention of the device by the user's foot or feet while also enabling instant, unimpeded movement of the foot into engagement and out of engagement with the device. The engagement should preferably provide strong support and protection for the feet in the manner of ski boots without immobilizing the feet relative to the underlying device as occurs during use of ski boots.

Users of many mobile devices of the above described kind must learn new physical skills and this can involve a lengthy training period. Safe control of some such devices can require substantial acrobatic skill on the part of the user. A foot engagement which enhances control of the device and which shortens the learning period would be highly advantageous.

The present invention is directed to overcoming one or more of the problems discussed above.

SUMMARY OF THE INVENTION

In one aspect, the present invention provides a mobile device which supports a person while enabling travel of the person along an underlying surface. The mobile device includes a foot receiving component having at least one partially open foot chamber with an elongated floor and which is further bounded by a back wall extending upward at the back of the chamber and by a side wall at one side of the chamber and by a top wall which extends laterally from the side wall towards the opposite side of the chamber at a location which is forward from the back wall and spaced apart therefrom. The chamber has an access opening at the opposite side of the chamber which is shaped to enable entry and withdrawal of the person's foot at that side of the chamber. The access opening has an upper region which extends laterally towards the side wall at the top of the chamber and which is shaped to receive the person's ankle.

In another aspect of the invention, the mobile device has a motion facilitating component situated below the foot receiving component and further includes means for fastening the motion facilitating component to the foot receiving component. The fastening means enables selective disengagement of the motion facilitating component and attachment of another such component of differing configuration.

In another aspect of the invention, the mobile device has at least a first and a second wheel for contacting the underlying surface and which are attached to the foot receiving component. The first wheel is at a location forward from the foot chamber and the second wheel is at a location behind the foot chamber.

In another aspect of the invention, the mobile device has at least one elongated board extending in the direction of travel of the device and has an underside positioned to contact the underlying surface and to travel therealong in contact therewith. The board is below the foot receiving component and is attached thereto.

In still another aspect, the invention provides a mobile device which enables travel of a supported person along an underlying surface which device is of the type having a foot receiving component that establishes positions for the person's right and left feet and which also has a motion facilitating component situated therebelow for contact with the underlying surface. The foot receiving component has a right foot chamber and a left foot chamber disposed in side by side relationship and which extend substantially in the direction of travel of the device. A right foot chamber access opening has a lower region at the right side of the foot receiving component and an upper region which extends over the right foot chamber. The left foot chamber access opening has a lower region at the left side of the foot receiving component and an upper region which extends over the left foot chamber. The access openings are shaped to enable entry of a person's feet into the foot chambers and withdrawal of the person's feet by lateral movements of the person's feet.

The invention provides a form of foot engagement, resembling an open sided boot, which enables secure retention of a mobile recreational device by the user while also enabling instant, unimpeded entry and withdrawal of the user's foot. The configuration of the engagement inherently provides strong support for the foot and facilitates control of the device by use of the feet. These characteristics make the foot engagement compatible with the differing requirements of different types of mobile device, such as skateboards, snowboards, snow skis, waterboards, water skis, roller skates or in-line skates of the type having just two aligned wheels among other examples. Having the option of freely disengaging one or both feet can be comforting and enhances safety during activities, such as skiing or skating, in which the person's feet have traditionally been positively secured to the equipment by bindings or the like. In one form of the invention, any of a variety of different interchangeable surface contacting elements may be fastened to a single foot engaging component. This effects cost savings by enabling use of the single component for a variety of different recreational activities.

The invention, together with further aspects and advantages thereof may be further understood by reference to the following description of the preferred embodiments and by reference to the accompanying drawings.

FIG.. 16 is a side view of a wheeled scooter embodying the invention.

Figure 1:
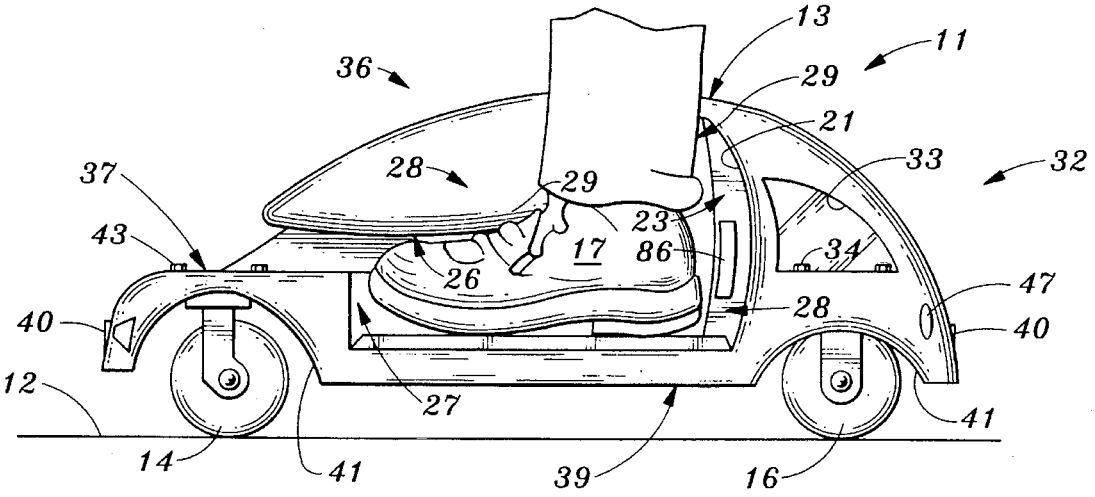
FIG. 1 is a side view of a mobile device for traveling a person along an underlying surface in accordance with a first embodiment of the invention.
Figure 2:
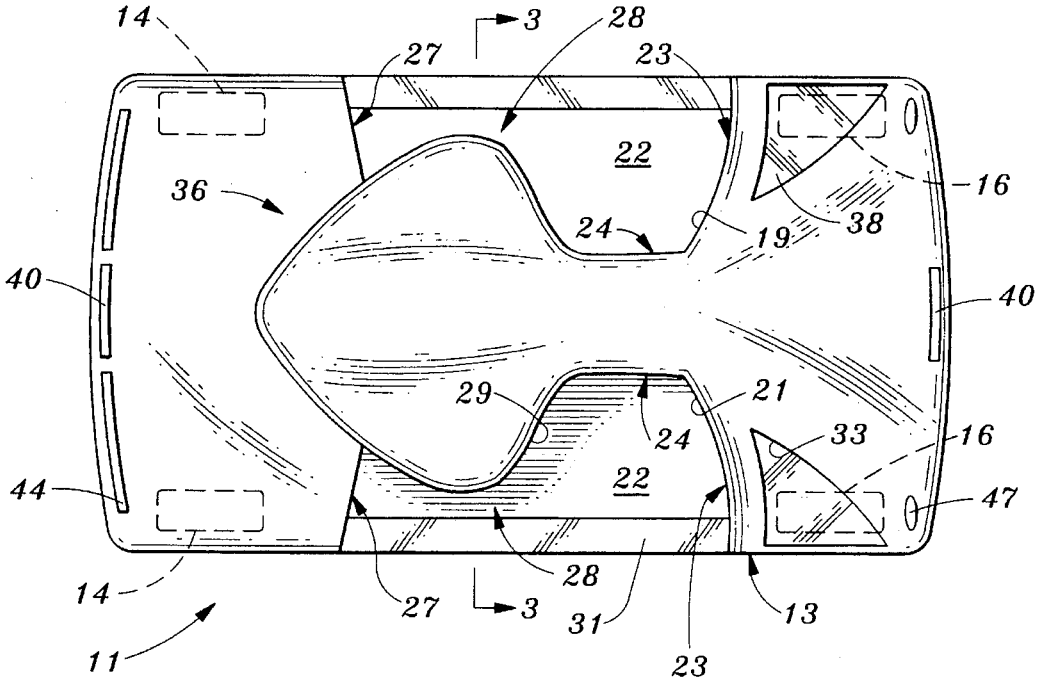
FIG. 2 is a top view of the mobile device of FIG. 1.
Figure 3:
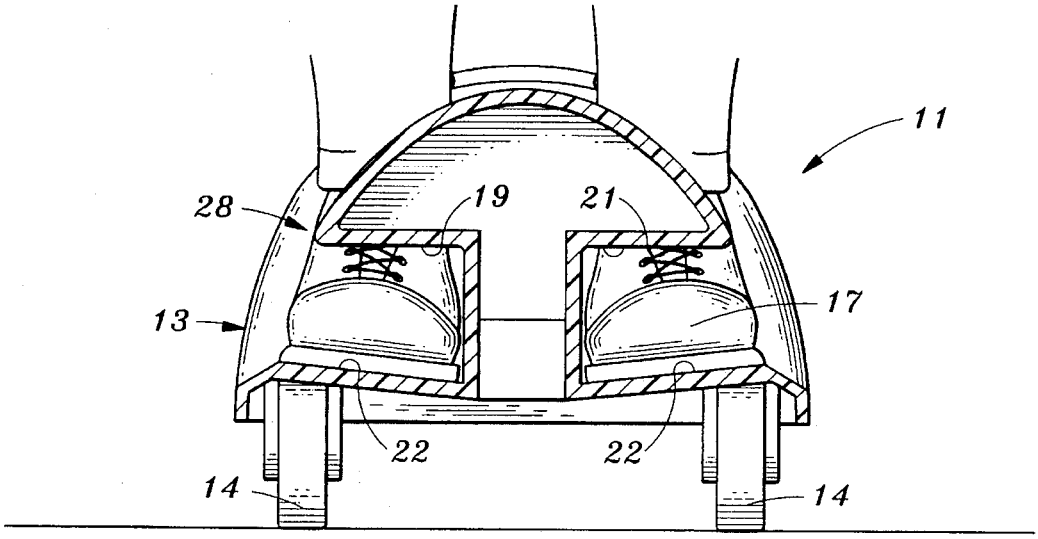
FIG. 3 is a cross section view of the apparatus of the preceding figures taken along line 3—3 of FIG. 2.
Figure 17:
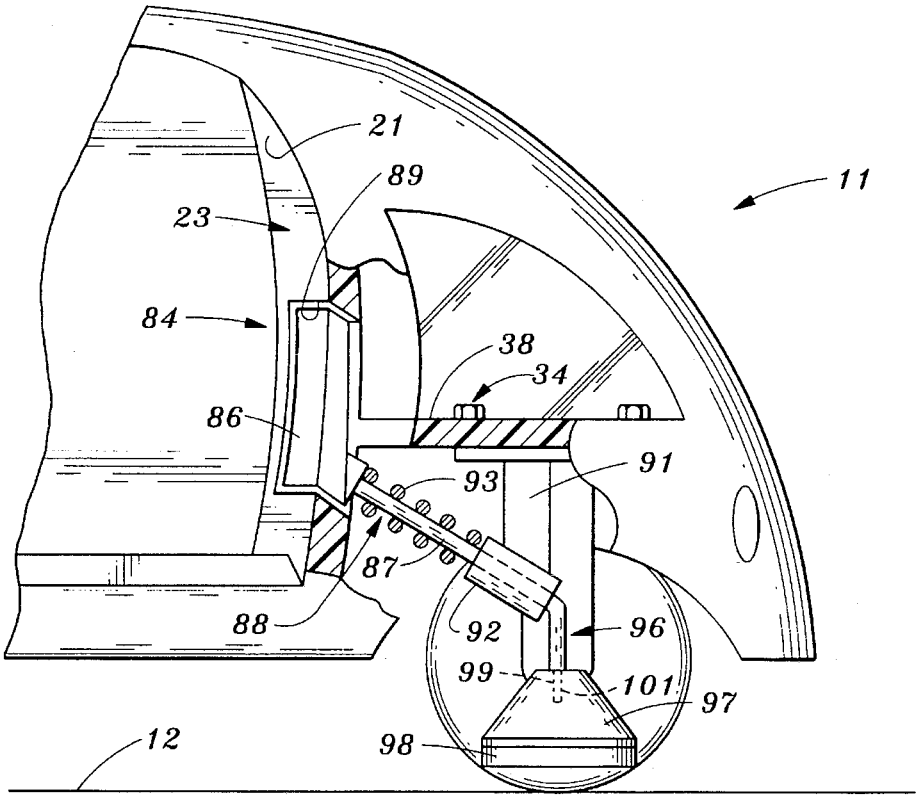

FIG. 17 is a broken out side view of a rear portion of the mobile skating device of FIG. 1 illustrating foot operated braking means which may be included in the construction.

Figure 18:
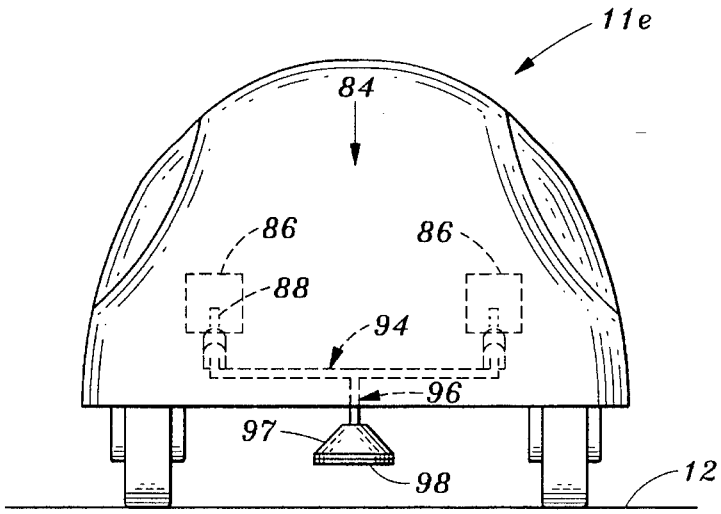

FIG. 18 is a rear view of the apparatus of FIG. 17.

Figure 19:
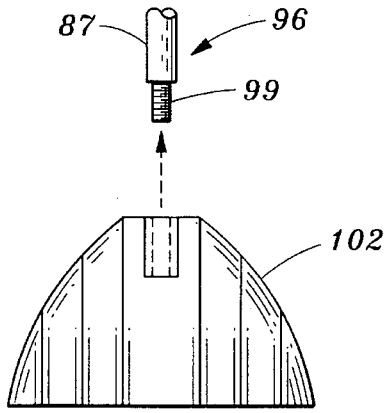

FIG. 19 an exploded view illustrating means for adapting the brake of FIGS. 17 and 18 for use on devices which travel on soft or liquid surfaces such as on snow or water.

DETAILED DESCRIPTION OF THE PREFERRED EMBODIMENTS

Referring initially to FIGS. 1 to 4 of the drawings in conjunction, the invention is applicable to any of a variety of mobile devices 11 of the general type that support a standing, seated or prone person and which enable travel of the person along an underlying surface 12 which may variously be land, pavement, flooring, snow, ice or a body of water. The mobile device 11 of FIGS. 1 to 4 may quickly be reconfigured for operation on different types of surface and/or for different modes of operation as will hereinafter be further described. For purposes of an initial example, the mobile device 11 of FIGS. 1 to 4 is shown in a configuration which enables operation on hard surfaces 12 in the manner of a skateboard.

Device 11 has a foot receiving component or foot receiver 13 which rides on one or more surface contacting components which in this example are front wheels 14 and rear wheels 16. In the most common mode of operation, the skateboarder stands on the device 11 and propels it along the underlying surface 12 by repeatedly pushing against the surface with a foot 17. This requires that the person's feet 17 be freely movable off of and then back on to the device 11. Foot receiver 13 has foot engagements which enable secure retention of the device 11 by the user's feet without impeding such free maneuvering of the feet.

In particular, the foot receiver 13 has indentations which form a right foot chamber 19 and a left foot chamber 21. The foot chambers 19 and 21 are disposed in side by side relationship and each had an elongated floor 22 which extends in the direction of travel of the device 11 and which are shaped to enable resting of the user's feet 17 on the floors. Each chamber 19 and 21 has a configuration which resembles a boot that is open on its outer side. For this purpose, each chamber has an upward extending back wall 23 and a side wall 24 which extends upward at the inner side of the chamber. A top wall 26 extends laterally from side wall 24 towards the open outer side of the chamber 19, 21 at a location which is forward from back wall 23 and spaced apart from the back wall. Each chamber further has a front wall 27 that is of less height than the back wall 23.

The absence of outer walls causes the foot chambers 19 and 21 to have access openings each of which has a lower region 28 extending along the foot receiver 13 and an upper region 29 which extends laterally at the top of the chamber towards the inner side wall 24 of the chamber. Thus the configuration of the foot chambers 19 and 21 enables unimpeded entry of a person's feet 17 and withdrawal of the feet by lateral movements of the feet. The term lateral movement as used herein and in the appended claims refers both to a strictly sideward movement of the foot and to movement in which the foot may be traveled in a forward or backward direction while it is also being moved in a sideward direction.

The inner side walls 24 jointly form an upwardly directed pedestal which can be clasped by the user's feet when necessary for steering or other control purposes or to retain the device 11 when it is above the underlying surface 12. The toe regions of the feet 17 can be abutted against front walls 27, the arch regions of the feet can abut top walls 26 and the backs of the feet can abut back walls 23 when necessary to exert control forces on the device 11, to retain the device or to brace the user's feet. Top walls 26 are the undersurfaces of wing like projections 28 which extend laterally outward from inner side walls 24. The front ankle regions of the user's feet 17 may be abutted against the laterally extending rear surfaces 29 of projections 28 which in effect enables hooking of the mobile device 11 by the person's feet.

To facilitate entry and withdrawal of the person's feet, the back walls 23 of the foot chambers preferably slant backward while the front walls 27 and surfaces 29 of projections 28 slant forward. This divergent configuration of the walls acts to guide the person's feet into place during entry of the feet and enables unimpeded removal of the feet. Downward slanting ramp surfaces 31 which extend along the outer edges of the chamber floors 22 further facilitate entry and withdrawal of the feet.

The floors 22 of chambers 19 and 21 slant downward towards inner side walls 24. This causes gravity and other forces which may arise during operation to act in a manner that tends to retain the feet 17 in the chambers 19 and 21. Such forces have the effect of urging the feet 17 towards the inner side walls 24. Optionally, the chamber floors 22 can have a slightly concave shape to resist horizontal sliding of the feet relative to the floors.

The external shape of the foot receiver 13 can take different forms but preferably the receiver has a rounded profile to reduce aerodynamic drag. In the present example, the receiver 13 has a configuration resembling the shape of an automobile. A hollow trunk region 32 behind foot chambers 19 and 21 has windows 33 at each side which enable entry of the hands during engagement and disengagement of bolts 34 which fasten the rear wheels 16 to the foot receiver 13. Foot chamber top walls 26 and projections 28 are formed by a rounded, sloping turret like region 36 of the receiver 13 which extends forward from the top of the foot chambers. A flat horizontal hood region 37 of the receiver 13 extends over the front wheels 14 and a flat horizontal platform region 38 extends over the rear wheels 16 at the base of trunk region 32. The bottom region of the receiver 13 forms a downwardly directed skirt 39 which extends around the receiver below the hood region 37, foot chambers 19 and 21 and trunk region 32 and which has notches 41 at the locations of the wheels 14 and 16 which simulate the appearance of fenders. Notches 41 facilitate accessing of bolts 34 and 43 and the front pair of the notches enable unimpeded swiveling of the caster wheels 14.

Optionally, the foot receiver 13 can be provided with further embellishments, such as simulated license plates 40 for example, that are suggestive of an automobile. The foot receiver 13 need not necessarily have the automobile simulating appearance described above. For example, the portions of the trunk region 32 that are situated above and/or directly behind windows 33 can be eliminated. This eliminates the windows 33 and provides a fully open area above bolts 34.

Figure 4:
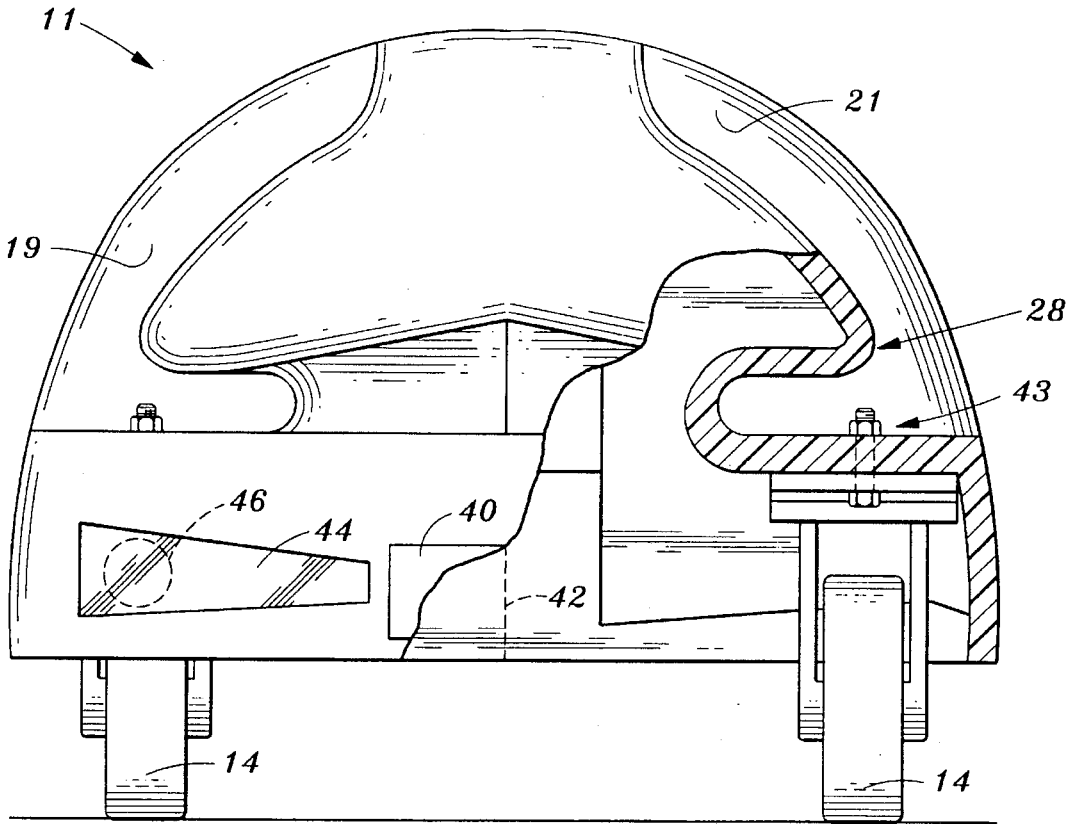
FIG. 4 is a broken out front view of the apparatus of the preceding figures.

With reference to FIG. 4 in particular, a foot receiver 13 of the described and depicted shape can be easily assembled by forming different portions of the receiver as initially separate moldings of high strength plastic, such as reinforced fiberglass for example, and then bonding the moldings together. For example, the right and left halves of foot receiver 13 can be initially separate moldings that are bonded together along the central vertical plane 42 of the receiver. The receiver 13 may also be formed by other techniques such as rotomolding or by injection molding.

Steering of a conventional skateboard involves sideward tilting by shifting of the body and foot pressure on the board. This can be difficult to learn and can be hazardous if performed by an inexperienced person. Steering is simplified in this example of the invention as the front wheels 14 are caster wheels of the kind which are free to swivel about vertical axes that are offset from the horizontal axes of rotation of the wheels. This enables turning of the device 11 without sideward tilting. The rear wheels 16 have a fixed alignment relative to the foot receiver 13.

Front wheels 14 are situated forward from foot chambers 19 and 21 and are fastened to the hood region 37 of receiver 13 by bolts 43. The rear wheels 16 are behind the foot chambers 19, 21 and are fastened to platform region 38 of the receiver. This enables use of wheels which are larger than those customarily found on skateboards or the like without requiring that the person's feet be at an undesirably elevated location. A low placement of the person's feet enhances stability. Stability is further enhanced in this embodiment by locating the wheels 14 and 16 in close proximity to the sides of the foot receiver 13.

Various accessories can be carried by the device 11. For example, transparent or translucent windows 44 may be provided in the front region of skirt 39 and headlights 46 may be situated in back of the windows. Light reflectors 47 be mounted at the back of receiver 13 or at other locations.

Figure 5:
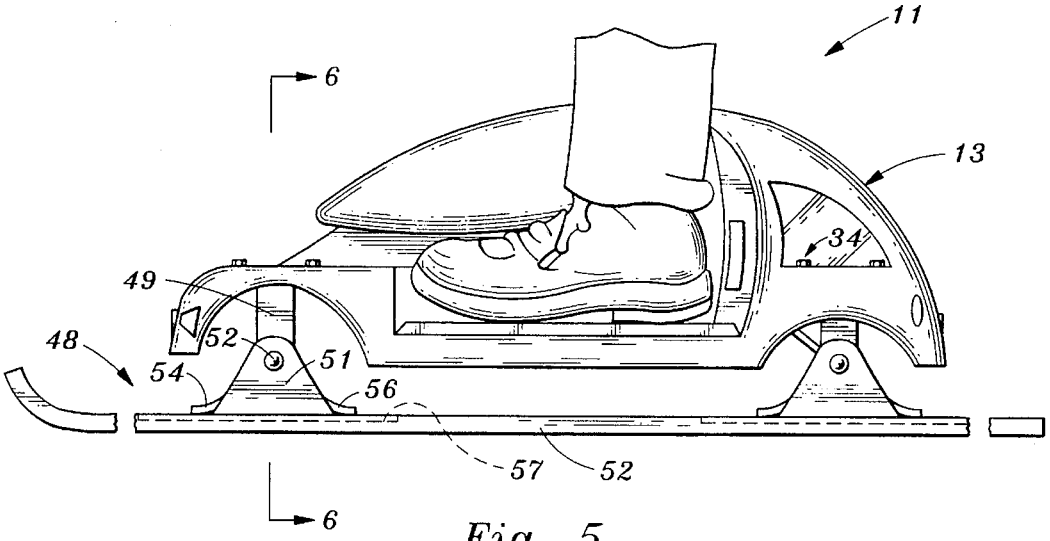
FIG. 5 is a side view of the apparatus of the preceding figures shown converted from a skating device to a skiing device.
Figure 6:
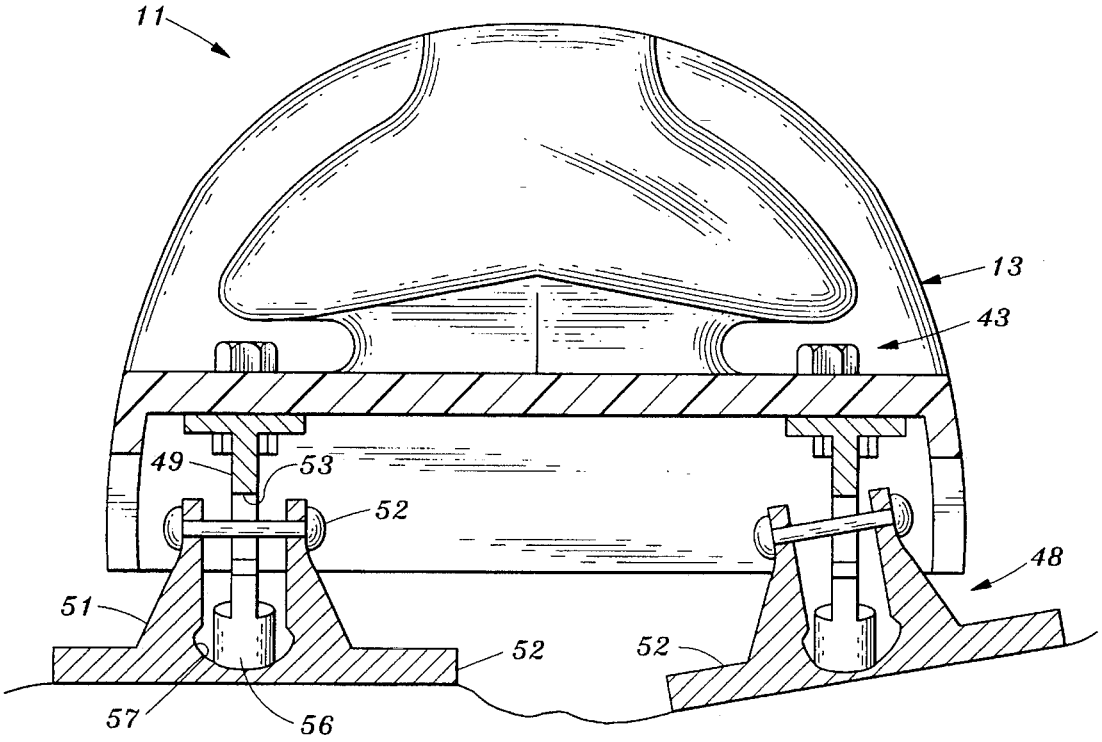
FIG. 6 is a cross section view of the apparatus of FIG. 5 taken along line 6—6 thereof.

The mobile device 11 can be converted for use in diverse activities by replacing wheels 14 and 16 with other forms of running gear. For example, with reference to FIGS. 5 and 6, the wheels may be replaced with a pair of ski attachments 48. Each such attachment 48 has front and rear vertically extending connector legs 49 which may be fastened to the foot receiver 13 using the same bolts 34 and 43 that formerly attached the wheels. Parallel, spaced apart brackets 51 extend upward from skis 52 at the location of each connector leg 49. The legs 49 extend between the pair of brackets 51 and the skis are fastened to the legs by cross pins 52 which extend through the pairs of brackets and through passages 53 in the connector legs.

Figure 7:
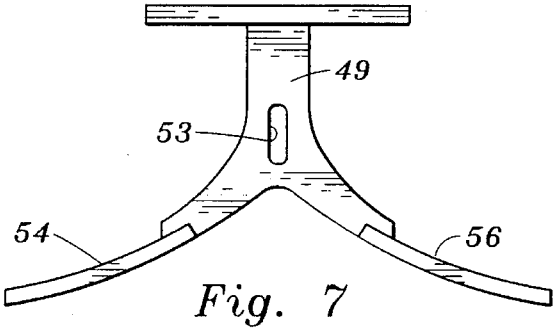
FIG. 7 is a side view of flexible arm ski connector component of the apparatus of FIGS. 5 and 6.

The skis 52 may be rigidly fastened to legs 49 but preferably, as in the present example, are able to tilt both laterally and longitudinally relative to the legs. This enables independent self positioning of each ski 52 to accommodate to irregularities in the snow surface by longitudinal flexing or by sideward tilting. For this purpose, with reference to FIG. 7, each connector leg 49 has a bifurcated configuration in which a first curved resilient arm 54 extends forward from the lower end of the leg and a second similar arm 56 extends backward from the leg. Referring again to FIGS. 5 and 6, arms 54 and 56 seat in grooves 57 which extend along the upper surface of skis 52 between each pair of brackets 51. The brackets 51 of each pair are spaced apart a distance which exceeds the widths of connector legs 49 including arms 54 and 56 and the passages 53 of the legs are elongated in the vertical direction. Thus the skis 52 may pivot sidewardly and may flex in the upward and downward directions to self adjust to terrain irregularities. Grooves 57 have an arcuate cross section and the undersurfaces of arms 54 have a matching curvature. This produces forces which act to maintain the skis 52 in a right angled orientation relative to connector legs 49 and to maintain the legs in a centered relationship between brackets 51 in the absence of terrain irregularities.

The pair of skis 52 can, if desired, be replaced with four shorter skis, each being attached to a single one of the connector legs 49.

Figure 8:
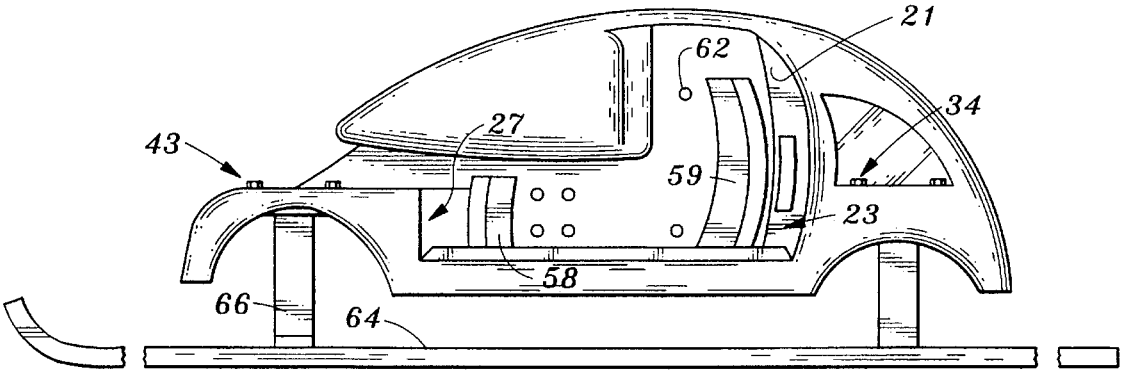
FIG. 8 is a foreshortened side view of the apparatus of the preceding figures shown converted for use as a snow board and further showing first means for adapting the device to engage feet of differing sizes.
Figure 9:
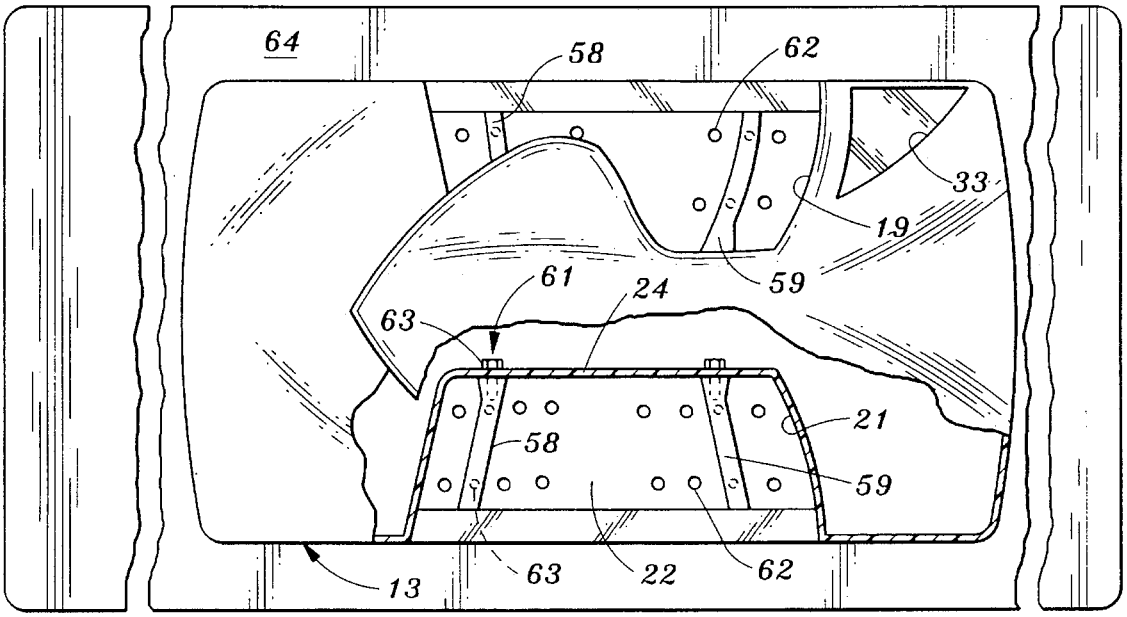
FIG. 9 is a foreshortened and broken out top view of the apparatus of FIG. 8.

It is not essential that the length of the foot chambers 19 and 21 conform precisely with the length of the user's feet but control and retention of the device 11 is facilitated if there is an approximate correspondence of such lengths. This can be provided for by manufacturing the devices 11 with foot chambers of differing length or by proportioning the chambers to accommodate to large feet and by providing adjustable inserts with which the effective length of the chambers can be varied. Use of such inserts is highly advantageous in devices 11 which are used by growing children as it makes it unnecessary to periodically replace the foot receiver 13 with a new one having larger chambers. Referring jointly to FIGS. 8 and 9, the adjustable inserts may include a pair of front foot braces 58 proportioned for fitting into the foot chambers 19 and 21 at locations behind the fixed front walls 27 and a pair of rear foot braces 59 of greater height which are proportioned to fit into the chambers 19 and 21 at locations which are behind the front braces and forward from the fixed rear walls 23 of the chambers.

The front and rear foot braces 58 and 59 provide surfaces against which the toes and back of the feet can be abutted which surfaces are closer together than the fixed front wall 27 and fixed rear wall 23. To facilitate entry and withdrawal of the feet, the front braces 58 slant forwardly in the manner of front wall 27 and the rear braces 59 are curved and slant rearwardly in the manner of the fixed rear wall 23. Means 61 are provided for securing the braces 58 and 59 in place at any of a plurality of selected locations along the lengths of the foot chambers 19, 21. For this purpose, in the present example, the chamber floors 22 and inner side walls 24 have arrays of spaced apart apertures 62. Disengageable bolts 63 extend through selected ones of the apertures 62 and secure the braces 58 and 59 in place.

The embodiment of FIGS. 8 and 9 provides another example of the diverse types of interchangeable running gear that can be fastened to the foot receiver 13. In this example a single extensive flat board 64 has upwardly directed connector legs 66 which are secured to the corner regions of the foot receiver 13 by the previously described bolts 34 and 43. As depicted in FIGS. 8 and 9, the board 64 has a configuration appropriate for operating the device 11 in the manner of a snowboard. Buoyant boards specifically configured for surfboarding or for waterboarding may also be provided.

Figure 10:
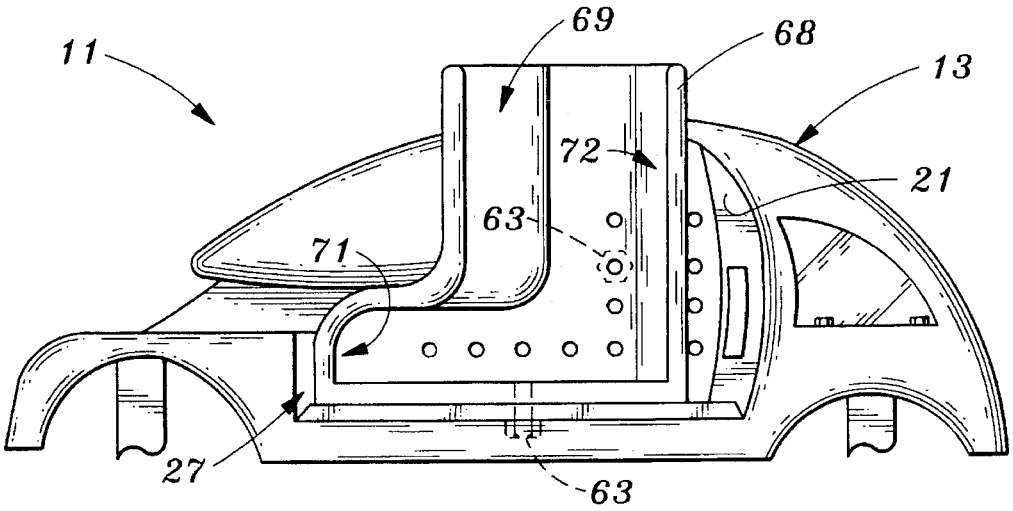
FIG. 10 is a side view of the feet engaging component of the apparatus illustrating a second means for adapting the device to engage feet of different sizes.
Figure 11:
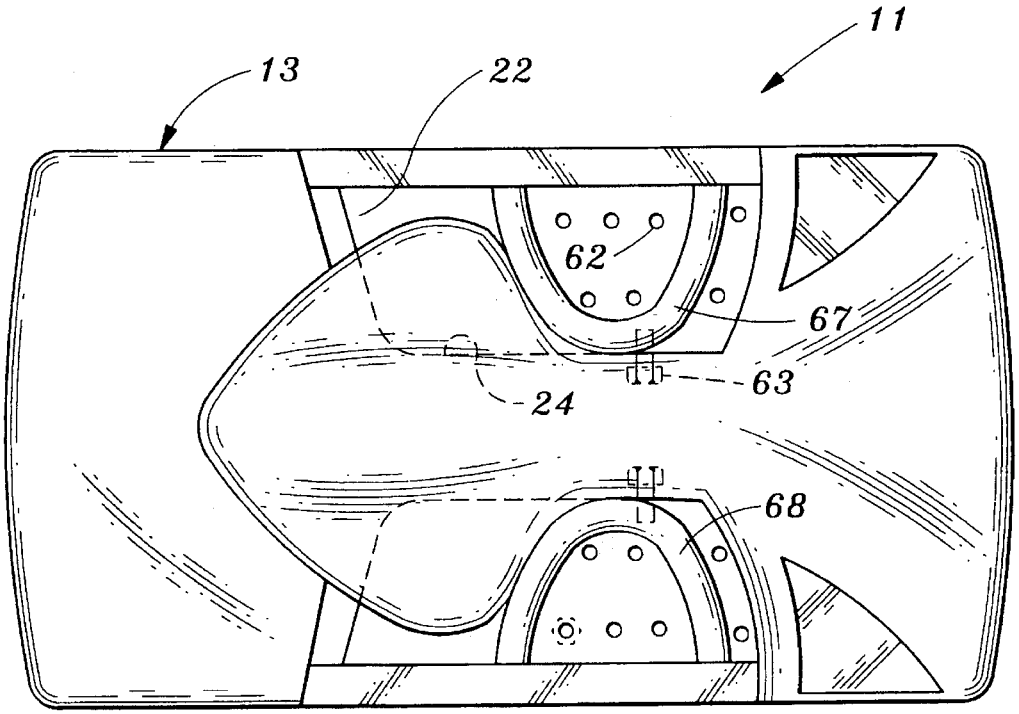
FIG. 11 is a top view of the apparatus of FIG. 10.

Referring now to FIGS. 10 and 11 in conjunction, an alternate means for accommodating the foot receiver 13 to different sized feet includes a right foot chamber insert 67 and a left foot chamber insert 68. Each such insert 67 and 68 has the configuration of a boot that is open at its outer side and thus in effect forms a subchamber for receiving a smaller sized foot. The front walls 69 and toe walls 71 of the inserts 67 and 68 preferably slant forward and the curved rear walls 72 of the inserts preferably slant backward to facilitate entry and removal of the feet as previously described in connection with the fixed walls of the foot chambers.

Inserts 67 and 68 can be provided in a variety of sizes to accommodate to different sized feet. The inserts 67, 68 are secured in place by bolts 63 which extend through apertures 62 in the floors 22 and inner side walls 24 of the foot chambers 19, 21.

Figure 12:
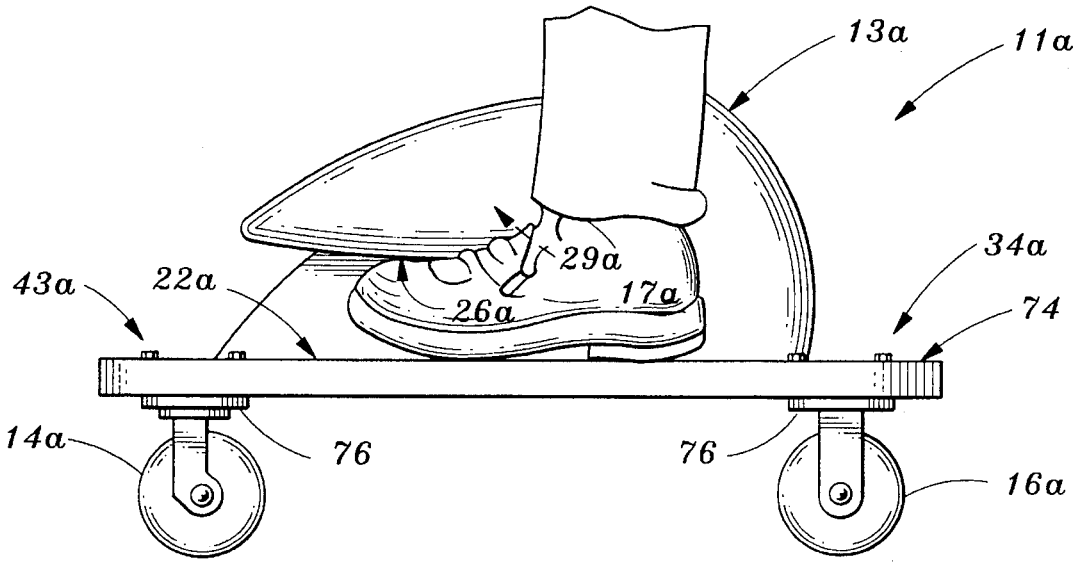
FIG. 12 is a foreshortened side view of another embodiment of the invention having a simplified, non-convertable construction.
Figure 13:
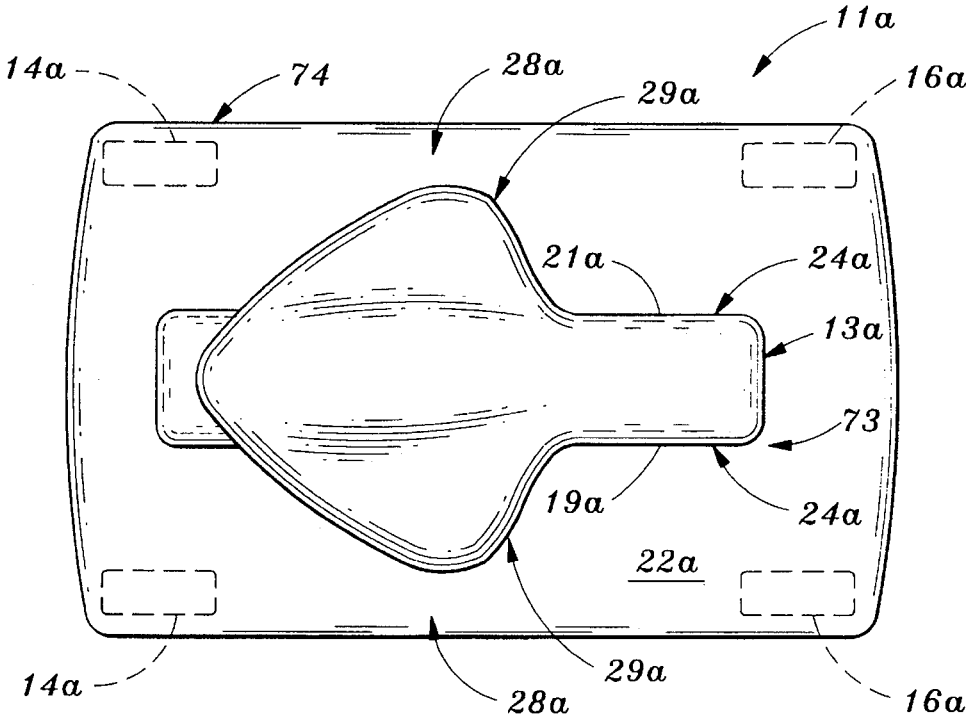
FIG. 13 is a top view of the apparatus of FIG. 12.

Referring jointly to FIGS. 12 and 13 a simplified form of foot receiver **13*a* may be used while still realizing enhanced control of a mobile device 11*a*. Receiver 13*a* has right and left foot chambers 19*a* and 21*a* with configurations similar to the previously described foot chambers except that the chambers 19*a* and 21*a* have no back walls and no front walls in the toe regions of the user's feet. Thus each foot chamber 19*a* and 21*a* is bounded only by a floor 22*a*, an inner side wall 24*a* and a top wall 26*a* which is the undersurface of a projection 28*a* which extends laterally outward from the inner side wall at a location forward from the back end 73 of the inner side walls. The rear surfaces 29*a* of projections 28*a*** are preferably angled forward as in the previously described embodiment.

The user's feet **17*a* a may be hooked under projections 28*a* with the ankles being abutted against the rear surfaces 29*a* of the projections. The inner side walls 24*a*** jointly form a pedestal which may be gripped by the user's feet.

The foot chamber floors **22*a* are portions of a rectangular board 74 which extends a small distance forward from and to the rear of the location of the user'feet. A spaced apart pair of front wheels 14*a* and a spaced apart pair of rear wheels 16*a* are situated below board 74 and are attached to the board by wheel brackets 76 and bolts 34*a* and 43*a*. Thus the mobile device 11a as shown in FIGS. 12 and 13 is configured for use in the manner of a skateboard but the wheels 14*a* and 16*a*** can easily be replaced with skis or boards suitable for snow or water travel of the previously described kinds.

Figure 14:
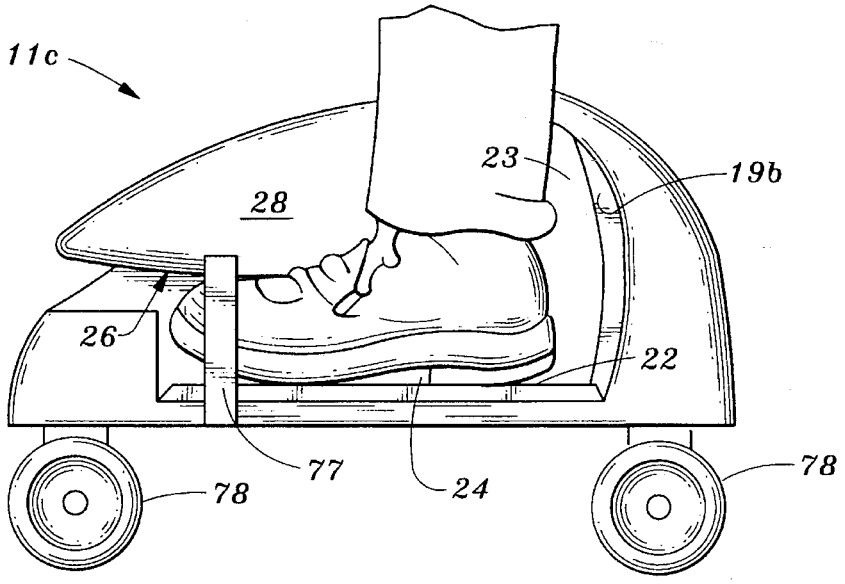
FIG. 14 is a side view of a pair of roller skates embodying the invention.
Figure 15:
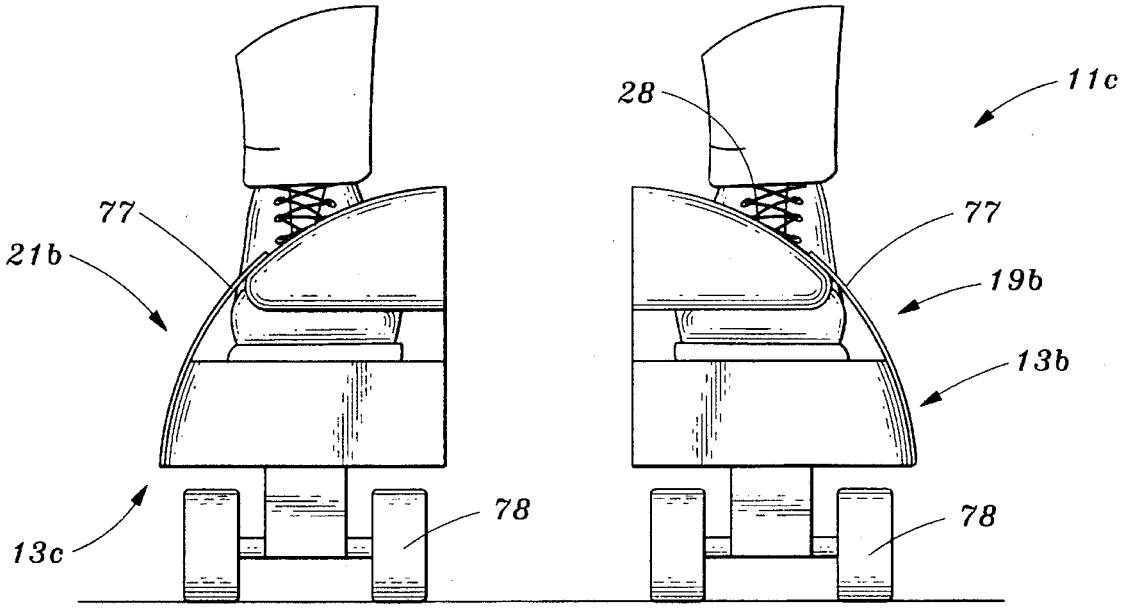
FIG. 15 is a front view of the roller skates of FIG. 14.

The embodiments of the invention which have been described up to this point are designed for engagement by both of the user's feet. Referring jointly to FIGS. 14 and 15, separate foot receivers may be provided for each of the user's feet to enable activities such as roller skating, ice skating or roller blading which involve independent movement of the feet.

The left foot receiver **13*b* and right foot receiver 13*c* have foot chambers 19*b* and 21*b* respectively similar to those previously described with reference to the embodiment of FIGS. 1 to 4. Thus the foot chambers 19*b* and 21*b* are bounded by elongated inwardly slanted floors 22, back walls 23, inner side walls 24 and top walls 26 which extend laterally over the arch regions of the feet in front of the user's ankles. Retention of the foot recievers on the feet can be facilitated by straps 77 which extend from projections 28 to the outer edges of the floors 22 of the foot chambers 19*b* and 21*b* at locations adjacent the toe regions of the user's feet which straps may, if desired, be integral portions of the material of which the foot receivers 19*b* and 21*b*** are formed.

The independent foot receivers **19*b* and 21*b* have roller skate wheels 78 attached to the undersides of the receivers in this embodiment. This is for purpose of example only as the foot receivers may ride on various other forms of running gear such as roller blades, ice skating blades or skis. Independent foot receivers 19***b* and 21*b* of the type shown in FIGS. 14 and 15 may also be bolted or otherwise secured to pre-existing boards such as snowboards, surfboards, water skis or the like to facilitate control and retention of foot engagement with such boards.

Figure 16:
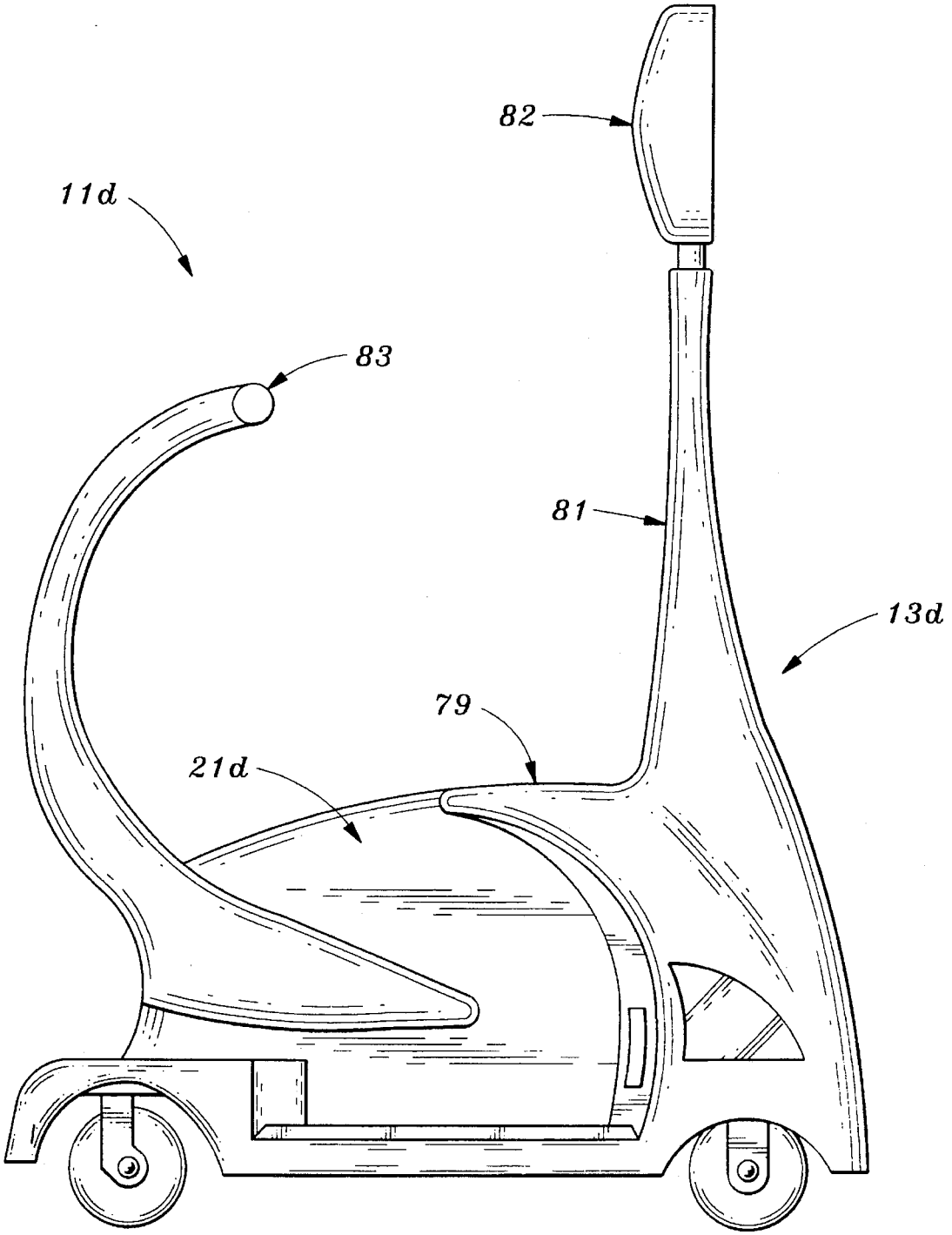

The previously described embodiments are devices of the type that the user stands on. Foot receivers embodying the invention also facilitate use of mobile devices of the type on which the user travels in a sitting position or lies prone on as in the case of a luge. For example, with reference to FIG. 16, a mobile device 11*d* which may otherwise be similar to the embodiment of FIGS. 1 to 4 may have a vertically extended foot receiver 13*d* which forms a seat 79, back rest 81 and head rest 82. Vertically extended foot chambers, such as left foot chamber 21*d*, extend in a forward direction towards the front of seat 79 to accommodate to the bent knees of a seated rider. An upwardly directed handlebar extension 83 may also be provided in front of the seat 79 and back rest 81. The handle bar extension 83 is fixed and non-turnable in this example as steering may be accomplished by body movement and foot pressure as in the operation of a skateboard but steerable front wheels and a turnable handlebar may be provided if desired.

Referring again to FIG. 1, mobile devices 11 embodying the invention can, as an option, be provided with a brake 84 which does not require use of the hands to effect braking or destabilizing tilting of the device as in the case of conventional skateboards. Referring jointly to to FIGS. 17 to 19, the brake 84 of this example has a brake pedal 86 situated in a conforming recess 89 in the back wall 23 of each of the foot chambers 19 and 21 in position to be operated by backward movement of a user's foot. The recesses 89 and pedals 86 are situated above the level of the foot chamber floors 22 so the backs of the user's heels may be abutted against the foot chamber back walls 23 without inadvertently actuating the brake.

A brake shaft 87 has arms 88 which extend backward and downward from each pedal 86 through holes 90 in the recessed regions of back walls 23. Brackets 91 extend downward from the underside of the platform 38 of the trunk region of the foot receiver and support inclined brake shaft guide sleeves 92 through which the arms 88 of brake shaft 87 extend. Helical compression springs 93 are disposed in coaxial relationship with shaft arms 88 between the pedals 86 and guide sleeves 92 and act to urge the pedals forward towards their unactuated positions. The back ends of arms 88 are linked by a cross member portion 94 of the brake shaft 87 and a final portion 96 of the shaft extends downward at the center of the cross member portion. A brake shoe 97 is fastened to the lower end of the final portion 96 of shaft 87 and may have a lining 98 of high friction material secured to its underside. Thus operation of either brake pedal 86 by the back of the user's foot travels shoe 97 downward causing lining 98 to bear against the underlying surface 12 and thereby slow and/or stop travel of the device 11 or thereby prevent unwanted rolling of the device when it is intended to be stationary.

The brake shoe 97 is designed for use on hard surfaces such as pavement and can be replaced with a different form of braking member when the mobile device 11*e* is converted for use on soft surfaces such as snow or water. Shaft 87 has a threaded end 99 which engages in a threaded bore 101 in the shoe. Thus, as depicted in FIG. 19, the shoe may be detached and be replaced with a transversely extending blade 102, which is preferably corrugated, that can penetrate into snow or water to decelerate the mobile device 11*e*.

The brake 84 can be located at the front of the foot chambers if desired although the rear location is more suitable for most activities. The brake 84 can also have a single pedal 84 situated in a single one of the foot chambers but during some activities it is helpful if either foot can be used for braking. Brakes which bear against the wheels 16, rather than the underlying surface 12, can be used in instances where the mobile device 11 will only be used for activities in which the device travels on wheels.

In instances where the mobile device is provided with foot braces 58, 59 as previously described with reference to FIGS. 8 and 9 or with inserts 67, 68 as previously described with reference to FIGS. 10 and 11, the option of providing a brake may be realized by providing a longer brake shaft 87 and by providing openings in the rear foot braces 59 or the back wall of the insert into which the brake pedals 86 may extend.

The above described embodiments of the invention are propelled by the user's physical effort, by gravity or are towed. Wheeled embodiments of the invention can be motor driven if desired.

While the invention has been disclosed with reference to certain specific embodiments for purposes of example, many modifications and variations of the mobile device are possible and it is not intended to limit the invention except as defined in the following claims.

I claim:

1. A mobile device for supporting a person and which enables travel of the supported person along an underlying surface, said mobile device having a motion facilitating component attached to a lower surface of the device and a foot receiving component which establishes a foot position at which the person places a foot, wherein the improvement comprises:

said foot receiving component having at least one partially open foot chamber which is bounded in part by an elongated floor shaped to enable resting of said person's foot thereon, said foot chamber being further bounded by a back wall which extends upward at the back of said chamber and a side wall which extends upward at one side of said chamber and by a top wall which extends laterally from said side wall towards the opposite side of said chamber at a location which is forward from said back wall and spaced apart therefrom, said foot chamber having an access opening with a lower region situated at said opposite side of said chamber which opening is shaped to enable entry of said person's foot into said chamber and withdrawal of said person's foot therefrom at said opposite side of said chamber, said access opening having an upper region which extends laterally towards said side wall at the top of said chamber between said top wall and said back wall and which is shaped to receive said person's ankle.

2. The apparatus of claim 1 wherein said floor of said foot chamber slants downward towards said side wall.

3. The apparatus of claim 1 wherein said foot receiving component has a ramp surface adjacent said floor at a base of said access opening which ramp surface extends outward and downward from said floor.

4. The apparatus of claim 1 wherein said foot receiving chamber is further bounded by a front wall which extends upward from said floor at the front of said chamber and which is of less height than said back wall.

5. The apparatus of claim 4 wherein said front wall and at least the lower portion of said back wall are divergent in a direction of said one side of said chamber.

6. The apparatus of claim 5 wherein a portion of said top wall which bounds said upper region of said access opening slants away from said side wall in a forward direction.

7. The apparatus of claim 1 further including a front foot brace disposed in said chamber at a forward location therein and extending upward from said floor, and means for securing said front foot brace in place at any of a plurality of different locations along the length of of said chamber.

8. The apparatus of claim 7 further including a rear foot brace disposed in said chamber at a rearward location therein and which extends upward from said floor, and means for securing said rear foot brace in place at any of a plurality of different locations along the length of said chamber.

9. The apparatus of claim 1 further including a liner insert disposed in said foot chamber, said liner insert having the shape of a boot which is open at one side and having inside dimensions which are smaller than the corresponding inside dimensions of said foot chamber, and disengageable means for securing said liner insert in place within said foot chamber.

10. The apparatus of claim 1 wherein said foot receiving component has a forward facing window situated in front of said foot chamber, further including at least one headlight mounted thereon.

11. The apparatus of claim 1 wherein said foot receiving component has at least one light reflector secured thereto.

12. The apparatus of claim 1 wherein said mobile device has a motion facilitating component situated below said foot receiving component, further including fastening means for attaching said motion facilitating component to said foot receiving component which means enables selective disengagement of said motion facilitating component from said foot receiving component and attachment of another motion facilitating component of differing configuration thereto.

13. The apparatus of claim 12 wherein said foot receiving component has a front platform which extends in front of said foot chamber at an elevation which is above the level of said floor of said foot chamber and has a rear platform which extends behind said foot chamber at an elevation which is above said level of said floor, and wherein said fastening means includes a first disengageable connector which extends up from said motion facilitating component and is fastened to said front platform and a second disengageable connector which extends up from said motion facilitating component and which is fastened to said rear platform.

14. The apparatus of claim 1 wherein said mobile device has at least a first and a second wheel for contacting said underlying surface and which are attached to said foot receiving component, said first wheel being at a location which is forward from said foot chamber and said second wheel being at a location which is behind said foot chamber.

15. The apparatus of claim 14 wherein said floor of said foot receiving component is situated below the level of the tops of said wheels.

16. The apparatus of claim 1 wherein said mobile device has at least one elongated board extending in the direction of travel of said device and having an underside positioned to contact said underlying surface and to travel therealong in contact therewith, said board being below said foot receiving component and being attached thereto.

17. The apparatus of claim 1 wherein said mobile device has a pair of said foot chambers including a right foot chamber and a left foot chamber disposed in side by side relationship and extending substantially in the direction of travel of said mobile device and wherein said lower region of said access opening of said right foot chamber is at the right side thereof with reference to the direction of travel of said mobile device and the lower region of said access opening of said left foot chamber is at the left side thereof with reference to said direction of travel.

18. In a mobile device for supporting a person and which enables travel of the supported person along an underlying surface, said device having a foot receiving component which establishes positions for said person's right and left feet and having a motion facilitating component attached to a lower surface of the device for contact with said underlying surface, the improvement comprising:

said foot receiving component having right and left sides with reference to the direction of travel of said mobile device and further having a right foot chamber and a left foot chamber disposed in side by side relationship and which extend substantially in said direction of travel of said device, said foot receiving component further including a right foot chamber access opening having a lower region at said right side of said foot receiving component and an upper region which extends laterally over said right foot chamber from a central portion of the device and further including a left foot chamber access opening having a lower region at said left side of said foot receiving component and an upper region which extends laterally over said left foot chamber from a central portion of the device, said access openings being shaped to enable entry of a person's feet into said foot chambers and withdrawal of a person's feet from said foot chambers by lateral movements of the person's feet.

19. The mobile device of claim 18 wherein said right and left foot chambers have floors which slant downward towards each other.

20. The mobile device of claim 19 wherein said foot receiving component has a right side ramp surface extending along said right side thereof at a base of said right foot chamber access opening and has a left side ramp surface extending along said left side thereof at a base of said left foot chamber access opening and wherein said ramp surfaces slant downward from said access openings.

21. The mobile device of claim 18 wherein said motion facilitating component includes a pair of front wheels and a pair of rear wheels coupled to said foot receiving component and extending downward therefrom for contact with said underlying surface and wherein said front wheels are caster wheels which are swivelable about vertical axes, said back wheels being constrained to remain aligned with the direction of travel of said mobile device.

22. The mobile device of claim 21 wherein said foot receiving component has an underside with at least one opening therein and wherein said wheels extend up into said foot receiving component.

23. The mobile device of claim 18 wherein said motion facilitating component includes at least one elongated board extending beneath said foot receiving component in the direction of travel of said mobile device, further including disenageable means for attaching said board to said foot receiving component.

24. The mobile device of claim 18 wherein said motion facilitating component includes a pair of parallel skis disposed in side by side relationship and extending beneath said foot receiving component in the direction of travel of said mobile device, further including disenageable means for attaching said skis to said foot receiving component.

25. The mobile device of claim 24 further including means for enabling independent sideward tilting of each of said skis in either sideward direction about axes that extend in the direction of travel of said mobile device.

26. The mobile device of claim 25 wherein said means for enabling independent sideward tilting of said skis also enables independent flexing of each of said skis in a vertical direction.

27. The mobile device of claim 18 further including a movable brake pedal disposed in at least one of said foot chambers in position to be translatable by movement of said person's foot, a brake member and means for lowering said brake member into contact with said underlying surface in response to translation of said brake pedal.

28. The mobile device of claim 27 wherein said means for lowering said brake member includes a brake shaft coupled to said brake pedal and which is lowered by translation thereof, further including first and second brake members, said first brake member having a substantially horizontally extending face adapted to contact said underlying surface to create frictional resistance to motion of said mobile device when said underlying surface is hard and said second brake member having a substantially vertically extending face adapted to penetrate said underlying surface to create resistance to motion of said mobile device when said underlying surface is water or snow, and fastening means on said brake shaft for enabling interchanging of said first and second brake members.

29. The mobile device of claim 18 further including a plurality of said motion facilitating components of differing configuration including at least a wheeled motion facilitating means and an elongated board motion facilitating means, further including fastening means for attaching any selected one of said motion facilitating components to said foot receiving component which means enables interchanging of said motion facilitating compoents.

30. The mobile device of claim 18 wherein said foot receiving component has an outer surface which forms the top and sides and front and back of said foot receiving component, said outer surface having a rounded configuration when viewed from the front and back thereof and also when viewed in profile.

31. The mobile device of claim 30 wherein said foot receiving component has a hollow compartment situated behind said right and left foot chambers and has at least one window providing access to said compartment.

* * * * *